US007795819B2

(12) United States Patent
Kiernan et al.

(10) Patent No.: US 7,795,819 B2
(45) Date of Patent: Sep. 14, 2010

(54) DISCHARGE LAMP CONTROLS

(75) Inventors: Michael Noel Kiernan, Swansea (GB); Jan Simonsen, Struer (DK); Robert Marc Clement, Swansea (GB)

(73) Assignee: Cyden Limited, Swansea (GB)

( * ) Notice: Subject to any disclaimer, the term of this patent is extended or adjusted under 35 U.S.C. 154(b) by 203 days.

(21) Appl. No.: 11/781,504

(22) Filed: Jul. 23, 2007

(65) Prior Publication Data

US 2008/0290810 A1 Nov. 27, 2008

Related U.S. Application Data

(63) Continuation-in-part of application No. 11/628,417, filed as application No. PCT/GB2005/001977 on May 20, 2005, now Pat. No. 7,710,044.

(30) Foreign Application Priority Data

Jun. 3, 2004 (GB) ..... 0412352.7

(51) Int. Cl.
*H05B 37/02* (2006.01)

(52) U.S. Cl. ..... 315/241 S; 315/200 A; 606/2; 606/9; 607/88

(58) Field of Classification Search ..... 315/241 S, 315/241 P, 200 A, 201, 228–232, 294, 312; 340/468, 471, 472, 331; 606/2, 3, 9, 10–12; 607/88–92

See application file for complete search history.

(56) References Cited

U.S. PATENT DOCUMENTS

| | | | | |
|---|---|---|---|---|
| 3,846,811 | A | 11/1974 | Nakamura et al. | |
| 5,886,620 | A * | 3/1999 | Stewart et al. | 315/241 S |
| 5,956,535 | A | 9/1999 | Tohyama | |
| 5,982,275 | A * | 11/1999 | Kosich | 315/200 A |
| 6,373,197 | B1 * | 4/2002 | Chang | 315/241 S |
| 6,571,061 | B2 | 5/2003 | Kawasaki et al. | |
| 6,888,319 | B2 * | 5/2005 | Inochkin et al. | 315/243 |
| 6,965,203 | B2 * | 11/2005 | Changaris et al. | 315/200 A |
| 2004/0085026 | A1 | 5/2004 | Inochkin et al. | |
| 2004/0147985 | A1 * | 7/2004 | MacFarland et al. | 607/90 |

FOREIGN PATENT DOCUMENTS

| | | | |
|---|---|---|---|
| DE | 4141675 | A1 | 7/1992 |
| GB | 2060288 | A | 4/1981 |
| GB | 2414872 | A | 7/2005 |
| GB | 2417148 | A | 2/2006 |
| WO | PCTGB2008050586 | | 7/2008 |

* cited by examiner

*Primary Examiner*—Douglas W Owens
*Assistant Examiner*—Ephrem Alemu
(74) *Attorney, Agent, or Firm*—Kohn & Associates, PLLC

(57) ABSTRACT

At least one electric discharge lamp capable of generating a broadband output pulse of a range of wavelengths in the visible spectrum, the output pulse having a predetermined time interval and a predetermined total electrical energy input for the pulse, has a drive circuit for delivering energy pulses to the electrical discharge lamp, as well as a sensor for sensing an optical output from the discharge lamp; and a control mechanism for operating the drive circuit in response to variations in optical output detected by the sensor.

10 Claims, 7 Drawing Sheets

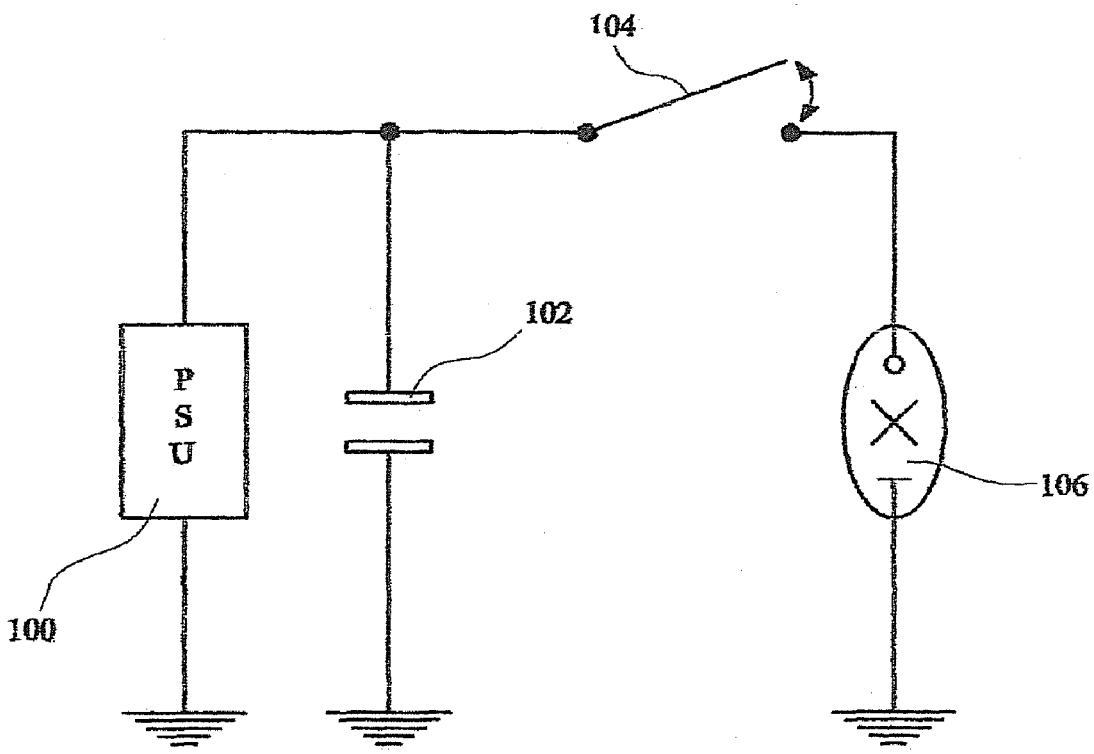
PRIOR ART
FIG. 1A
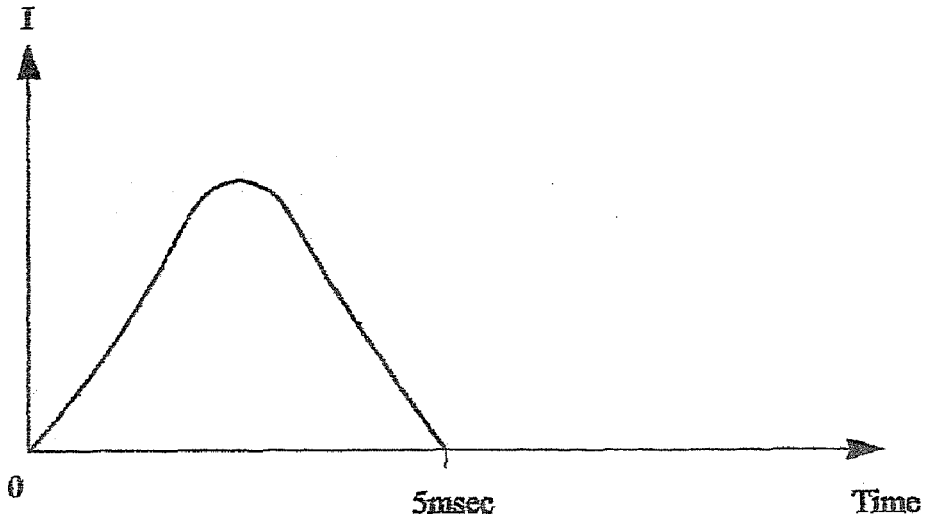
PRIOR ART FIG. 1B

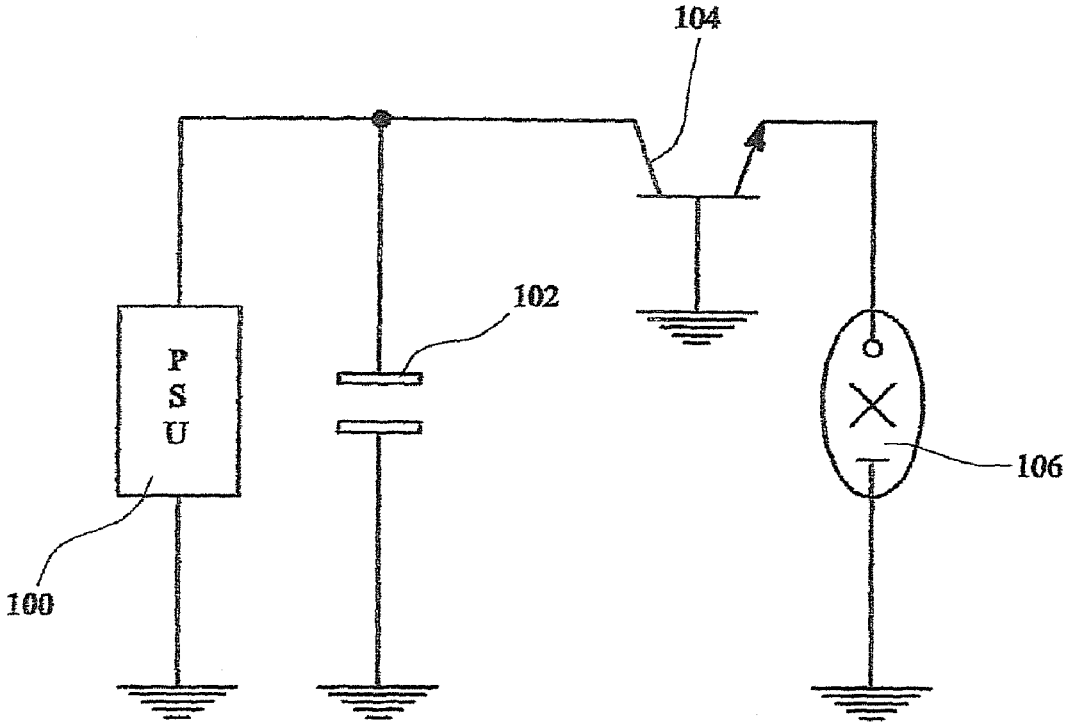
PRIOR ART FIG. 2A
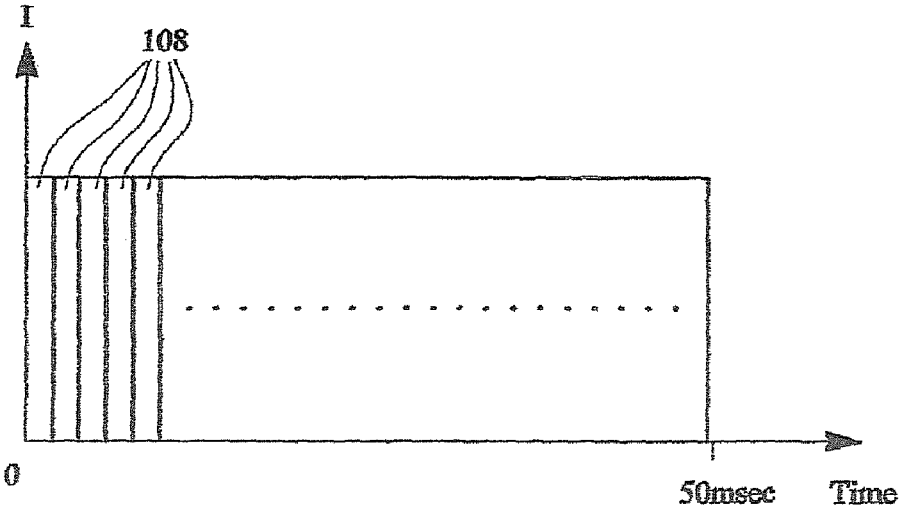
PRIOR ART FIG. 2B

DISCHARGE LAMP CONTROLS

CROSS-REFERENCE TO RELATED APPLICATIONS

This is a Continuation-in-Part Application of U.S. patent application Ser. No. 11/628,417, filed 12 Apr. 2006 now U.S. Pat. No. 7,710,044, being the US national phase of PCT Patent application GB2005/001977 dated 20 May 2005.

TECHNICAL FIELD

This invention relates generally to controls for discharge lamps suitable for providing broadband incoherent light sources suitable for medical and cosmetic applications.

It is known that discharge lamps for providing incoherent light sources for such purposes have several advantages over traditional laser technology, including their low cost, and the facts that they produce multiple wavelengths permitting multiple uses, and are subject to less stringent regulatory control.

BACKGROUND OF THE INVENTION

A typical discharge lamp for such medical and cosmetic applications comprises a xenon arc flashlamp located within a reflector shaped to direct the optical output from the flashlamp to a treatment site.

The flashlamp is typically driven by a capacitor discharge circuit where the electrical energy required is stored in a capacitor until the output optical pulse is required. When the optical output is required, the electrical energy is delivered to the flashlamp, thereby converting the electrical energy to optical output.

In such an arrangement, the current flowing through the flashlamp varies during the pulse, proportional to the discharge characteristics of the capacitor. This variation in the current during the pulse produces a varying intensity of optical energy and induces a shift in the output wavelength spectra as the output wavelength is determined by the plasma temperature within the flashlamp, and the plasma temperature is governed by the current flowing.

Referring to FIG. 1A of the drawings, there is illustrated a simplified version of a conventional flashlamp drive circuit, in which a power supply unit 100 is used to charge a relatively small capacitor 102, in this case say 500 μF. A switch 104 is provided between the capacitor 102 and the flashlamp 106. Examples of switches used in the past have included thyristors, which once turned on, generally remain on until the capacitor has fully discharged, and transistors. When the switch 104 is closed, the capacitor 102 is substantially completely discharged to the flashlamp 106, giving a drive current pulse similar to that illustrated in FIG. 1B, whereby around (say) 150 J of energy (defined by the area under the curve in FIG. 1B) is delivered to the flashlamp in around 5 ms.

However, there are applications, particularly medical applications, where the shape of the optical pulses used to drive the flashlamp is important in order to achieve the desired therapeutic effect, and in particular to achieve such effect without damage to areas of the patient's body not being treated. For example, in optical dermatology, it may be desirable to rapidly heat a target chromophore to a selected temperature, and to then reduce applied energy so as to maintain the chromophore at the desired temperature. It is therefore highly desirable for the shape and duration of the optical pulses delivered to the flashlamp to be controllable.

Referring to FIG. 2A of the drawings; there is illustrated a simplified form of another known flashlamp drive circuit, in which a power supply unit 100 is used to charge a relatively large capacitor 102 (say, 0.2 F) up to, say 1500 J, and a switch 104 (embodied in this case by a transistor) is used to deliver a small portion of this total energy (say 150 J) at a time. In view of the manner of operation of this type of partial discharge system, an optical pulse can be delivered to the flashlamp 106 with a relatively uniform energy distribution, as illustrated in FIG. 2B of the drawings. Effectively, a drive system of the type illustrated in FIG. 2A of the drawings, delivers a plurality of small packets 108 of energy. Thus, in the case where 150 J of energy are delivered in a 50 ms-time interval, each packet 108 will consist of 0.03 Jμs. As a result, it is possible, using such a system, to control the shape of the optical pulse delivered to the flashlamp in order to achieve the desired effect.

However, a major disadvantage of the partial discharge system described with reference to FIG. 2A of the drawings, is the size of the capacitor 102, whereas it is highly desirable in all flashlamp applications to minimize the size of the capacitor (and therefore the charge it carries) as this has the effect of minimizing the size, weight and cost of the lamp drive circuitry and enhances the safety of such drive circuits by reducing shock risks.

A method aimed at producing a constant current during the optical pulse is proposed in U.S. Pat. No. 6,888,319. This approach provides a drive circuit for a pulsed flashlamp which circuit includes a sensor for power through the lamp, and a series regulator which operates an on/off switch between the energy storage capacitor and the flashlamp, the switching frequency being determined by monitoring the current flow or power within the circuit. This approach can provide a relatively constant current output during the overall current pulse and is commonly referred to as a flywheel circuit as described in, for example, U.S. Pat. No. 4,513,360.

Whilst providing a constant current pulse does have advantages, this approach does not provide constant optical output, because the output optical power can depend upon many external factors that are not manifested as variation in current. These factors include, but are not limited to, gas fill pressure, gas purity, operating temperature, flashlamp envelope degradation, flashlamp envelope coating (often flashlamps are coated to improve conduction) or flashlamp envelope doping (doping the envelope can selectively filter certain wavelengths). Many of these parameters can vary during usage; for example, it is common for flashlamp output to degrade through usage as contaminants can cause optical fluctuations. Such contaminants can cause optical degradation but may not affect the current flowing in the flashlamp.

OBJECT OF THE INVENTION

It is an object of the present invention to provide flashlamp drive control, and a corresponding method of driving a flashlamp, whereby the shape and duration of the current pulses delivered to the flashlamp is highly uniform.

SUMMARY OF THE INVENTION

The present invention therefore provides, in combination, at least one electric discharge lamp capable of generating an output pulse of a range of wavelengths in the visible spectrum, the output pulse having a predetermined time interval and a predetermined total electrical energy input for the pulse, a drive circuit for delivering a plurality of energy pulses to the electrical discharge lamp, a sensor for sensing an optical output from the discharge lamp; and a control mechanism for operating the drive circuit in response to changes in optical output detected by the sensor.

In the combination according to the invention, the drive circuit comprises a) a storage capacitor capable of storing electrical energy input, b) charge means for selectively charging the storage capacitor;

c) a switch for permitting delivery of electrical energy from said storage capacitor to the discharge lamp; and d) drive means for selectively opening and closing the switch throughout the predetermined time interval so as to deliver a plurality of packets of energy from the storage capacitor to the discharge lamp, each packet being of duration less than said predetermined time interval.

Thus, the present invention is intended to provide means for driving and controlling a circuit for a flashlamp, which effectively mimics the operation of the partial discharge system described above with reference to FIG. 2A of the drawings, using a relatively small capacitor by providing means for modulating the capacitor output at a high frequency to achieve the desired energy pulse.

Also in accordance with the present invention, there is provided a method of driving a pulsed radiation source, using a combination according to the invention, the method comprising providing a storage capacitor so as to be capable of storing electrical energy required to be delivered to the radiation source, and selectively charging the storage capacitor so as to deliver to the radiation source an energy pulse in the form of a plurality of packets of energy within a predetermined time interval, the method further comprising sensing the optical output from the discharge lamp; and controlling delivery of energy from the storage capacitor to the radiation source in response to optical output sensed by the sensor The invention further comprises an electric discharge lamp capable of generating a broadband output pulse of a range of wavelengths in the visible spectrum, the output pulse having a predetermined time interval and a predetermined total electrical energy input for the pulse, in combination with a drive circuit for delivering energy pulses to the electrical discharge lamp, a sensor for sensing an optical output from the discharge lamp; and a control mechanism for operating the drive circuit in response to optical output detected by the sensor.

Beneficially, the switch used according to the invention may be an insulated-gate transistor, such as an insulated-gate bipolar transistor (IGBT).

In a preferred embodiment, the storage capacitor is connected in parallel with the pulsed radiation source.

A combination according to the invention may comprise a plurality of flashlamps, each having associated therewith a respective storage capacitor and respective means for selectively charging and discharging said storage capacitor. Means, such as a digital signal processor and microprocessor, are beneficially provided for controlling the charge/discharge means.

The time interval for the optical pulse is typically 1 to 100 milliseconds (such as 10 to 100 milliseconds), whereas the individual packets of energy typically have an order of magnitude lower, such as a duration of 5 to 25 microseconds.

Preferably, the control includes a processor unit arranged to compare optical output sensed by the sensor with precalibrated values stored in a memory unit.

Preferably the control mechanism includes a high speed analog to digital converter for each sensor output.

It is preferred that a plurality of the discharge lamps is used; this enables a more uniform optical output to be achieved. Such a plurality of lamps is typically provided in a single reflector unit with a single light guide for the lamps.

When a plurality of discharge lamps is employed, the system preferably includes means for shutting down the discharge lamps when a detector indicates that one of the lamps has failed to generate the output pulse.

BRIEF DESCRIPTION OF THE DRAWINGS

Features of the present invention will now be described, by way of example only, and with reference to the accompanying drawings, in which;

FIG. 1A is a simplified circuit diagram of a first flashlamp drive circuit and flashlamp configuration according to the prior art;

FIG. 1B illustrates an energy pulse which can be delivered by the circuit of FIG. 1A;

FIG. 2A is a simplified circuit diagram of a second flashlamp drive circuit and flashlamp configuration according to the prior art;

FIG. 2B illustrates an energy pulse which can be delivered by the circuit of FIG. 2A;

DESCRIPTION OF PREFERRED EMBODIMENTS

Figure 3:
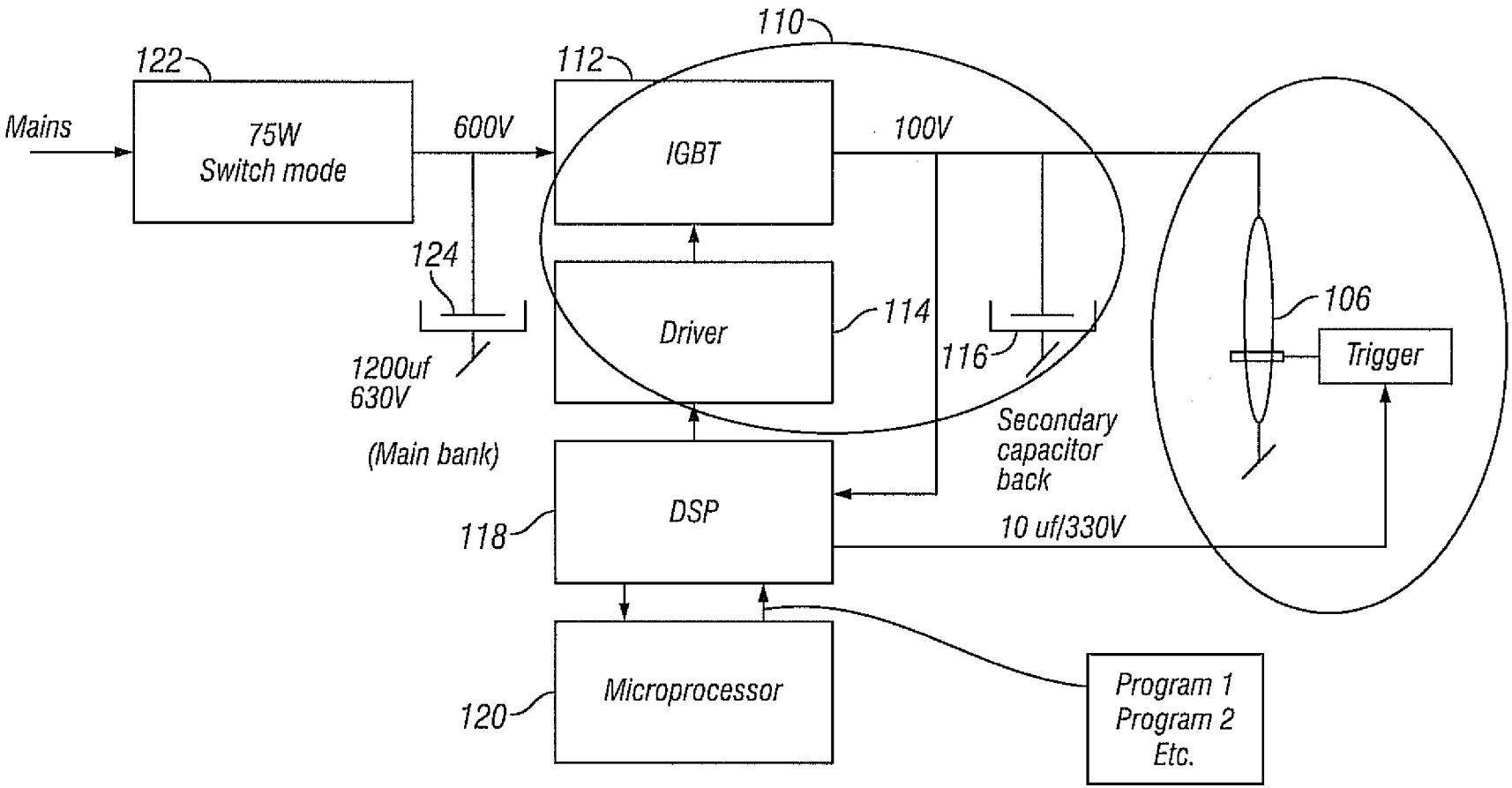
FIG. 3 is a schematic circuit diagram illustrating a flashlamp drive circuit and flashlamp configuration.
Figure 4:
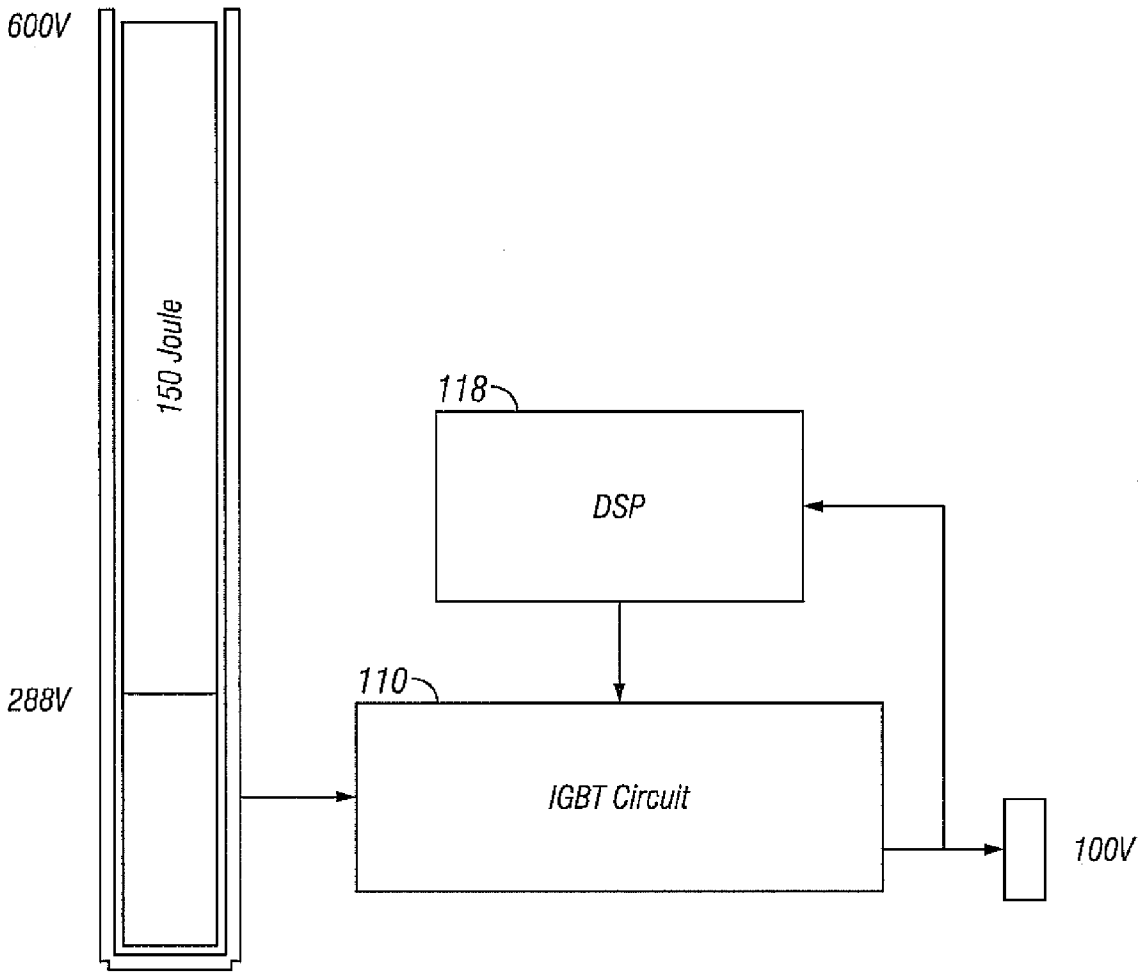
FIG. 4 illustrates schematically a portion of the circuit of FIG. 3.

Referring to FIGS. 3 and 4 of the drawings, there is illustrated a flashlamp unit including a drive circuit according to an exemplary embodiment of the present invention. The flashlamp 106 may, for example, comprise a delivery head carrying light emitting apparatus in the form of an electric discharge tube containing a high pressure Noble/inert gas such as Xenon or Krypton. The discharge tube operates to produce, in response to the input of a current pulse, a burst of light of a range of wavelengths in the visible spectrum (approximately in the range 400 to 700 nm). However, many different types of flashlamps and other pulsed radiation sources will be well known to a person skilled in the art, and their specific form and structure will not be described in any further detail herein. A bank of, say, six flashlamps or other pulsed radiation sources may be provided in a single unit, as required by the particular application.

Associated with the or each flashlamp 106, there is provided a switch mechanism 110 comprising an insulated-gate bipolar transistor (IGBT) 112 and a corresponding driver 114. The switch mechanism 110 also incorporates a secondary transistor 116, having a comparatively very small capacitance of (say) 10 μF. The capacitor 116 and the respective flashlamp 106 are connected in parallel with each other. A controller, comprising a digital signal processor (DSP) 118 and a microprocessor 120, is provided to control the operation of all of the flashlamps 106 in the bank via the respective switch mechanisms 110. It will be appreciated that the microprocessor 120 can be programmed so as to cause the digital signal processor 118 to run the bank of flashlamps in accordance with anyone of a number of different programs, depending on the application.

Figure 5A:
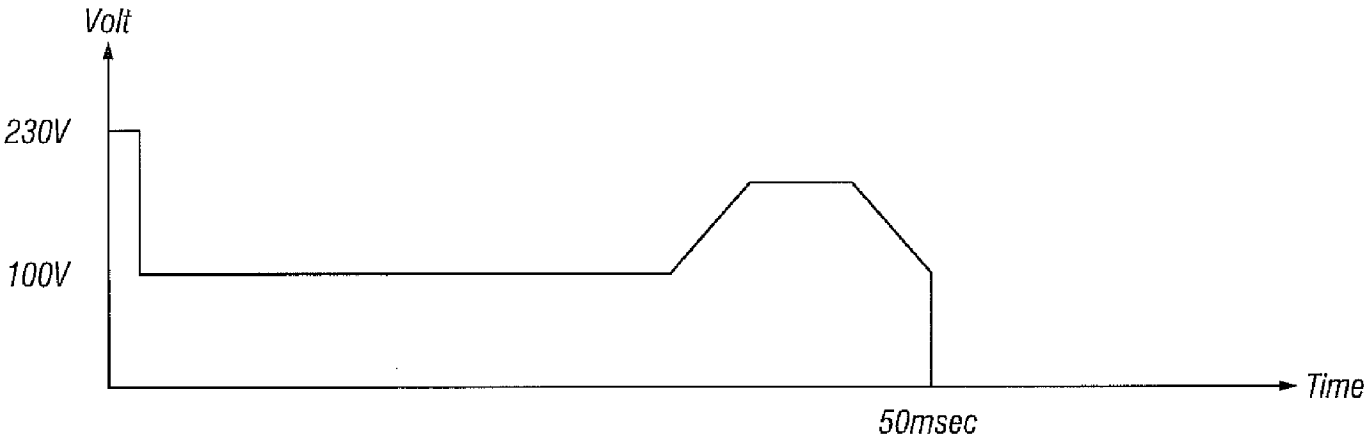
FIGS. 5A and 5B illustrate energy pulse forms which can be delivered by the circuit of FIG. 3.
Figure 5B:
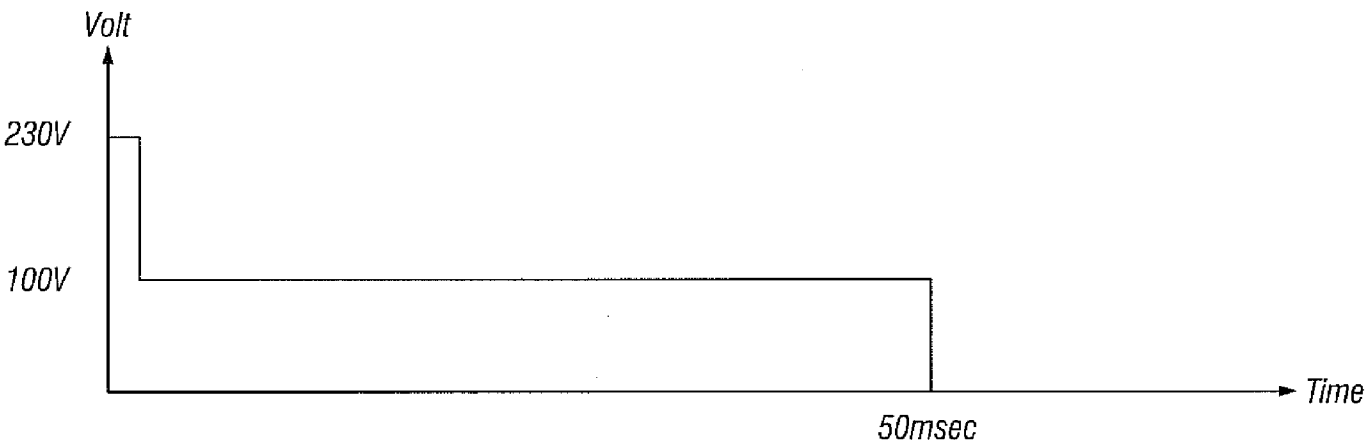

A switch mode power supply 122 and a primary capacitor 124 are also provided. In use, each drive pulse delivered to a flashlamp 106 is comprised of a plurality of smaller energy packets resulting from the high frequency, repeated charging and discharging of the respective capacitor 116, controlled by the DSP 118 via the respective driver 114. As a result, there is provided flashlamp drive circuitry, and a corresponding method of driving a flashlamp, whereby the shape and duration of the current pulses delivered to the flashlamp is highly controllable, and the size of the storage capacitor required is significantly reduced relative to known arrangements. Examples of the types of energy pulses which can be delivered using the drive circuit described above with reference to FIGS. 3 and 4 of the drawings; are illustrated in FIG. 5 of the drawings.

Circuits such as those shown in FIGS. 3 and 4 of the drawings are provided according to the invention with sensors for sensing an optical output from the discharge lamp 106; and a controller for operating the driver in response to optical output detected by such sensors. Such sensors and controllers are described in more detail in the following description with reference to FIGS. 6 and 7 of the accompanying drawings.

Figure 6:
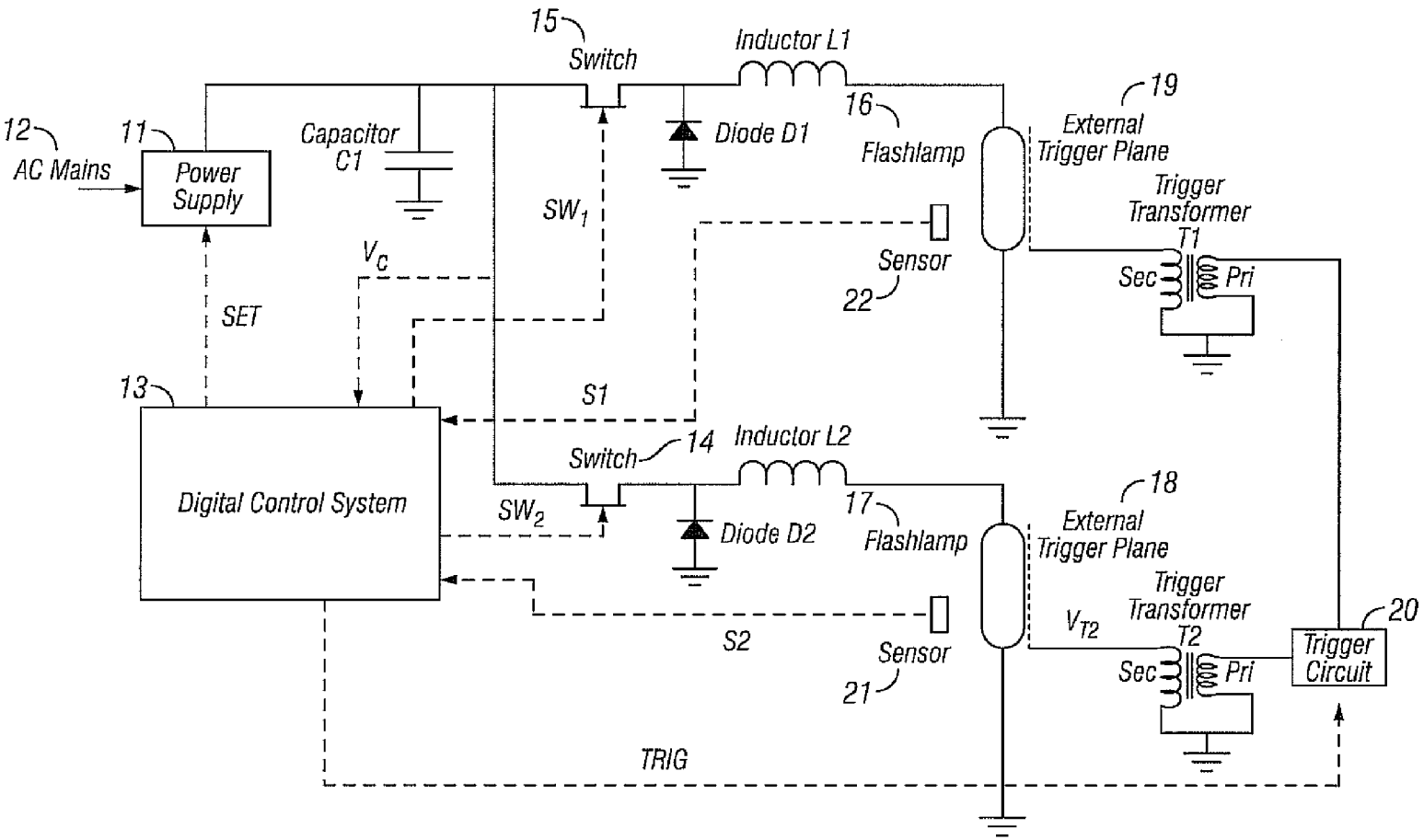
FIG. 6 shows an exemplary circuit and optical feedback system for use according to the invention.

Referring to FIG. 6, a power supply 11 has an AC mains supply 12 (typically at 110V or 240V AC 50/60 Hz) which is converted to a DC voltage. This DC voltage is used to charge energy storage capacitor C1, the voltage to which capacitor C1 is charged being controlled via the SET signal from a digital control system 13 to the power supply 11. A capacitor voltage Vc is monitored by the digital control system 13; when Vc is reached, the control system 13 turns off the power supply 11. During this charging period, semiconductor switches 14 and 15 are in OFF mode inhibiting current flow through the remainder of the circuit.

Flashlamps 16 and 17 (typically Xenon arc discharge lamps) are both in open-circuit mode, that is, there is no conduction path through the flashlamps. Capacitor C1 maintains its stored charge until required.

When optical output from the flashlamps 16 and 17 is required, firstly the flashlamps 16, 17 have to be "broken down" or "triggered" to create a conduction path through the gas within the flashlamp 16, 17. To trigger the flashlamps 16 and 17, a high voltage spike is applied to the external surface of the flashlamp glass envelope via external trigger planes 18 and 19. When the optical output is required, the control system 13 signals a trigger circuit 20 via a TRIG signal. The trigger circuit 20 applies a voltage pulse to the primary (Pri) winding of each of trigger transformers T1 and T2. The voltage on the primary winding (Pri) is amplified to induce a higher voltage on the trigger transformer secondary (Sec) windings.

The resulting trigger spikes or packets of energy $V_{T1}$ and $V_{T2}$ are typically 5-10 kV with a duration of 10 microseconds whilst the primary voltage pulse is in the order of 200-400V. This high voltage spike on the exterior of the flashlamp ionizes Xenon gas within the flashlamp leading to the formation of a conduction path from the flashlamp anode to cathode.

Simultaneously to the TRIG signal being applied to the trigger circuit 20, semiconductor switches 14 and 15 are turned on (that is, closed) to provide a conduction path, via control signals $SW_1$ and $SW_2$ from the control system 13. Providing the trigger spikes $V_{T1}$ and $V_{T2}$ have induced the necessary ionisation within the flashlamps 16 and 17, current will flow through inductors L1 and L2, both flashlamps ground producing the optical output from the ionized xenon gas within the flashlamps. Whilst the current is flowing through switches 14 and 15, and both flashlamps, from capacitor C1, inductors L1 and L2 store a proportion of the energy delivered from C1.

When the optical output from either flashlamp 16 or flashlamp 17 reaches a predetermined high level defined within the control circuit 13 and monitored by signal S1 and S2 from optical sensors 21 and 22, the control system 13 opens switch 14 or switch 15 accordingly to prevent further current flow from C1 through the corresponding flashlamp. For example, if flashlamp 16 reaches a preset optical output value, switch 14 is opened via SW.sub.1 from the control system 13 thereby preventing further current flow from capacitor C1. When switch 14 is opened, the stored energy within the inductor L1 induces a current which flows through flashlamp 17 via diode D1 (commonly referred to as a "flywheel" diode"). The optical output is monitored by the control system 13 via S1 and when this current decays to a predefined low point, switch 14 is closed thereby allowing current flow to resume from C1 which both maintains output in the flashlamp and stores energy within the inductor. This process operates concurrently and independently for flashlamp 16.

By repeating this process at a frequency in the order of 100-500 kHz, the optical output from the flashlamps can be maintained at a constant level for the duration of the required optical pulse (typically in the order of 1-100 milliseconds). In order to ensure constant output of the flashlamps during the required optical pulse, the duty ratio between the on and off times of both switches 14 and 15 is varied during the pulse to compensate for the voltage drop in capacitor C1 during the release of its stored energy.

Figure 7:
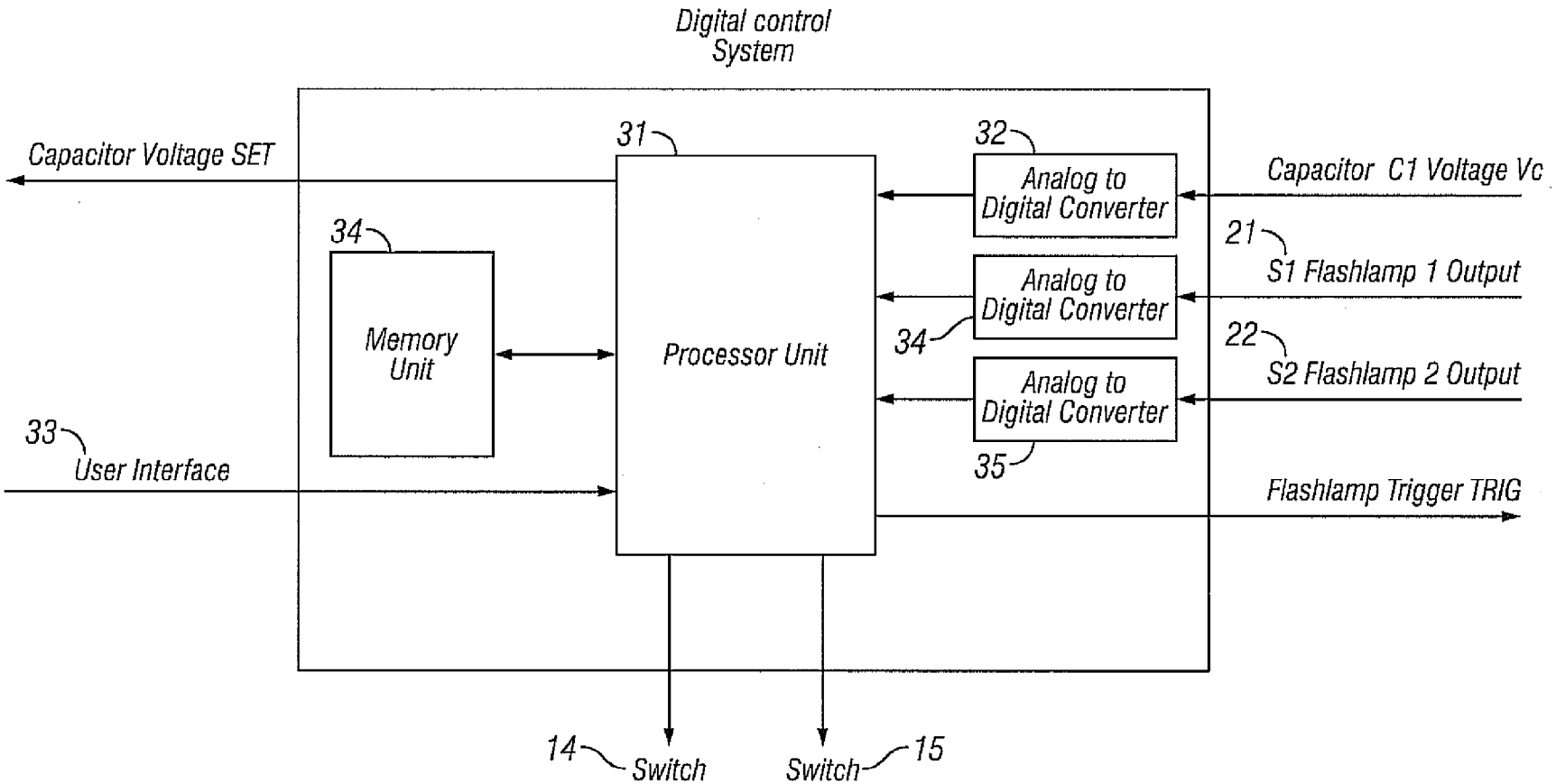
FIG. 7 shows an exemplary digital control suitable for use in the system of FIG. 4.

Referring to FIG. 7, the digital control system comprises a processor unit 31 which contains suitable control software algorithms for operation. The charge voltage of the capacitor C1 monitored by the V.sub.c signal is fed into an analog to digital converter 32, the digital output of which is read by the processor unit 31. Depending upon the required charge voltage V.sub.c, the processor unit 31 controls the power supply via the SET signal, when the desired V.sub.c is reached, the power supply output is terminated. When the stored energy is dissipated after the optical output pulse, capacitor C1 is recharged by the power supply as commanded by the processor unit 31.

An operator of the apparatus selects the desired output optical parameters such as energy, pulse duration and pulse sequence (single or multiple pulses) through a user Interface 33. A data table contained within the memory unit 34 is referenced by the processor unit 31 to obtain the predefined sensor readings which correspond to the level of output optical power required.

The signals from sensors 21 and 22 are converted to digital format by two independent analog to Digital Converters 34,35 to be read by the processor unit and compared to the predefined values as defined in the data table stored in a memory unit 34.

What is claimed is:

1. In combination, at least one electric discharge lamp capable of generating an output pulse of a range of wavelengths in the visible spectrum, said output pulse having a predetermined time interval and a predetermined total electrical energy input for said pulse, and a drive circuit for delivering a plurality of energy pulses to said electrical discharge lamp, the drive circuit comprising a) storage capacitor means capable of storing said electrical energy input, b) charge means for charging said storage capacitor means; c) switch means for permitting delivery of electrical energy from said storage capacitor means to said discharge lamp; and d) drive means for selectively opening and closing said switch means throughout said predetermined time interval so as to deliver a plurality of packets of energy from said storage capacitor means to said discharge lamp, each said packet being of duration less than said predetermined time interval; the combination further comprising sensor means for sensing an optical output from the discharge lamp; and control means for operating said drive means in response to variations in optical output detected by said sensor means.

2. A combination according to claim 1, wherein said storage capacitor means is connected in parallel with the electric discharge lamp.

3. A combination according to claim 2, wherein said electric discharge lamp comprises a xenon discharge tube.

4. A combination according to claim 1, wherein the switch means comprises insulated-gate bipolar transistor.

5. An electric discharge lamp unit including a combination according to claim 1, in which the drive circuit is connected to drive said discharge lamp.

6. Pulsed illumination apparatus which comprises a plurality of electric discharge lamp units according to claim 5, all said lamp units being arranged to receive electrical energy from a common capacitor and a common charge means.

7. An electric discharge lamp capable of generating a broadband output pulse of a range of wavelengths in the visible spectrum, the output pulse having a predetermined time interval and a predetermined total electrical energy input for the pulse, in combination with a drive circuit for delivering energy pulses to the electrical discharge lamp, the drive circuit comprising a) storage capacitor means capable of storing said electrical energy input, b) charge means for charging said storage capacitor means; c) switch means for permitting delivery of electrical energy from said storage capacitor means to said discharge lamp; and d) drive means for selectively opening and closing said switch means throughout said predetermined time interval so as to deliver a plurality of packets of energy from said storage capacitor means to said discharge lamp, each said packet being of duration less than said predetermined time interval; a sensor for sensing an optical output from the discharge lamp; and a control mechanism for operating the drive circuit in response to variations in optical output detected by the sensor.

8. A lamp according to claim 7, which includes a plurality of discharge tubes.

9. A lamp according to claim 8, wherein each discharge tube is arranged to receive electrical energy from a common capacitor means and a common charge means.

10. A method of driving a pulsed radiation source, the method comprising providing a storage capacitor so as to be capable of storing electrical energy required to be delivered to said radiation source, and selectively charging said storage capacitor so as to deliver to said radiation source said energy pulse in the form of a plurality of packets of energy within a predetermined time period, the method further comprising sensing the optical output from the discharge lamp; and controlling delivery of energy from the storage capacitor to the radiation source in response to variations in optical output sensed by the sensor.

* * * * *